US008752849B1

(12) United States Patent
Fox

(10) Patent No.: US 8,752,849 B1
(45) Date of Patent: Jun. 17, 2014

(54) DAMPING SYSTEM FOR SKATEBOARDS

(71) Applicant: Jeremy Fox, Huntington Beach, CA (US)

(72) Inventor: Jeremy Fox, Huntington Beach, CA (US)

( * ) Notice: Subject to any disclaimer, the term of this patent is extended or adjusted under 35 U.S.C. 154(b) by 0 days.

(21) Appl. No.: 13/841,518

(22) Filed: Mar. 15, 2013

(51) Int. Cl.
*B62M 1/00* (2010.01)

(52) U.S. Cl.
USPC ..... 280/87.042

(58) Field of Classification Search
USPC ..... 280/87.042, 11.28, 11.27, 11.19, 280/87.041
See application file for complete search history.

(56) References Cited

U.S. PATENT DOCUMENTS

| | | | | |
|---|---|---|---|---|
| 4,185,847 | A | 1/1980 | Johnson | |
| 4,251,087 | A | 2/1981 | Hansen | |
| 4,645,223 | A | 2/1987 | Grossman | |
| 5,263,725 | A | 11/1993 | Gesmer et al. | |
| 5,971,411 | A | 10/1999 | Jones et al. | |
| 6,224,076 | B1 * | 5/2001 | Kent | 280/87.042 |
| 6,811,168 | B2 * | 11/2004 | Acker et al. | 280/124.158 |
| 7,044,485 | B2 * | 5/2006 | Kent et al. | 280/87.042 |
| 8,251,383 | B2 | 8/2012 | Dickie | |
| 2011/0089659 | A1 * | 4/2011 | Hunt | 280/124.121 |

* cited by examiner

*Primary Examiner* — John Walters
*Assistant Examiner* — James Triggs
(74) *Attorney, Agent, or Firm* — Advantage IP Law Firm

(57) ABSTRACT

A damping system that incorporates a base plate and a hanger with an axle for receiving at least one wheel and a damping element coupling a skateboard deck or the base plate to the hanger and operable to retain the hanger in a normal alignment by introducing a resistance to the motion of the deck or base plate toward or away from the hanger for delaying, reducing, or preventing a speed wobble condition commonly encountered in skateboarding when traveling at a high rate of speed.

20 Claims, 13 Drawing Sheets

DAMPING SYSTEM FOR SKATEBOARDS

BACKGROUND OF THE INVENTION

1. Field of the Invention

The present invention relates generally to the field of skateboarding and, more particularly, to truck assemblies for use when skateboarding at high rates of speed.

2. Background

Skateboarding has become one of the more popular activities requiring a recreational device used by a rider to move across a solid support surface. A conventional skateboard typically includes a narrow, elongated platform or deck with an uppermost riding surface and a bottom surface to which a pair of wheel assemblies may be attached. The deck is sufficiently sized to allow the rider to be able to place at least a portion of both feet on the uppermost surface when riding the skateboard.

While initial skateboard decks were generally planar and made primarily out of wood of a single layer, more modern skateboard decks are known to incorporate laminated forms of two or more layers in a variety of non-planar shapes, including having a generally upwardly bent nose and/or tail end, and may be made out of a variety of different types of materials, including various metal, thermoplastic and composite materials.

The incorporation of wheels allows the skateboard to roll across a support surface due to gravity and/or a propelling action by the rider. As well known by persons familiar with skateboards, the rider also typically uses one foot to push against the ground in order to propel the skateboard and uses his or her body to tilt the deck to change the skateboard's direction of travel.

The typical wheel assembly used on most conventional skateboards includes a truck assembly with a baseplate secured to the bottom surface of the deck and a pair of wheels rotatably supported by the truck assembly. The typical skateboard truck assembly (the "truck") includes a hanger that may be secured to the baseplate by a kingpin, one or more compressible bushings which permit the hanger to pivot relative to the baseplate and the deck, and an axle which is supported by the hanger. One wheel is rotatably connected to each of the distal ends of the axle with each wheel being free to spin independently.

For the conventional skateboard, there is typically a wheel and truck assembly located toward the front and back ends of the deck and the truck assemblies are fixedly attached to their respective baseplates with mechanical connectors, such as rivets, screws, bolts and/or specially configured adhesives. The pivoting motion allows the rider to tilt the deck and gain more control of the skateboard's movement. Often, the wheels of a conventional skateboard are made out of polyurethane or like materials and the various structural components of the truck assembly are made out of metal, such as aluminum or steel, or various composites.

Each pair of wheels is typically mounted on a single axle per truck that is substantially parallel to the riding surface. While the typical direction of travel for a skateboard is along the longitudinal axis of the deck, the axles may be displaced by tilting the board as the rider leans thereby causing the hangers to pivot relative to the deck and orienting the wheels so that they steer the skateboard generally along the circumference of a circle in the direction of the lean or tilt.

While the foregoing generally describes a conventional skateboard, skateboards have continued to evolve as companies try to make them lighter and stronger, and continue to try to improve on their performance. As skateboards developed and improved in performance, riders continue to push the limits. One place to push the limit is on a slope or hill and many seek such locations out specifically to ride fast. When the rider rolls down the slope, he or she typically controls the speed of the skateboard by performing a generally zigzag or carving movement that slows the speed of the skateboard, thereby allowing the rider to safely control the skateboard. Alternatively, dragging one foot may be useful in controlling speed. Often, riders uncomfortable with higher speeds will simply walk down the hill or start a lower section of the hill until a certain level of confidence and skill is attained.

Besides maintaining control at higher speeds under normal conditions, when riding straight downhill or being pulled at high speeds, riders often encounter an undesirable condition known as "speed wobble" (also known as shimmy, wheel wobble, or death wobble) wherein the wheels and hanger begins to rock, tilt, and twist relative to the deck. In general, speed wobble describes the undesirable back and forth oscillation of the hanger and attached wheels of the skateboard creating a growing instability. This further leads to a rocking deck as each time the hanger tilts or pivots from a straight ahead (normal) alignment, the deck rocks to one side and then the other due to the oscillation which then typically increases in amplitude. The feedback from the wheels as they roll across the support surface exacerbates the problem. As the deck begins to tilt up and down an undesirable turning motion (both roll and yaw may be impacted) may be introduced and must be corrected to maintain control. Instead, typically, the rider over-corrects or cannot correct fast enough. Moreover, once a critical speed is reached, the oscillations may be too great to correct. This can occur both on long boards and regular sized skateboards.

To deal with speed wobble, riders are often advised to tighten the trucks. However, this only helps to a certain extent and reduces the ability to steer and maneuver and successfully make turns. Maintaining loose trucks may allow for greater maneuverability but facilitates wobble. In other words, stability may be traded for maneuverability, which is not desirable in most skateboarding scenarios. However, speed wobble is particularly dangerous when riding downhill and most riders may be ejected off a skateboard due to speed wobble, sometimes with serious results.

Speed wobble may also occur when the rider is not comfortable thus tensing the muscles in his or her ankles which causes the rider to over-correct his or her movements. This in turn may cause the rider's body and board to turn from side to side uncontrollably eventually resulting in the rider getting trampolined off forwards and sideways unless the rider can recover from the wobbles. Thus, another advised approach is to merely relax and ride with less tension to avoid tensing up due to panic and taking a mental approach. Once the rider commits to the speed and lack of control this may allow for both carving for control purposes but also tucking which provides tremendous speed. However, this approach takes a lot courage and experience before mastering and the speed wobble is a likely inevitable in any event.

Other solutions offered to improve stability besides tightening the trucks include using wider tricks and wheels, lowering the trucks, using harder bushings, and/or keeping most of the rider's weight over the front truck. Lower trucks and harder bushings may also provide more stability as well. However, too tight or too loose of trucks may pose problems as well when descending a steep hill, and it is difficult to test out different combinations to find a suitable solution. Moreover, changing out these parts for different conditions takes time away from riding and adds expense and inconvenience due to keeping various parts on hand.

While certain other proposed solutions attempt to cushion the ride by employing a pneumatic (gas) compression strut skateboard truck assembly (U.S. Pat. No. 6,224,076 to Kent) or a dual elastomeric suspension system (U.S. Pat. No. 7,044,485, to Kent at el.), the focus of the truck assemblies in these patents is on reducing single direction compressive shock forces generated by rolling over uneven ground surfaces. However, speed wobble is an undesirable oscillation between the hanger and wheels and the deck that requires an entirely different set of principles than that of reduction of single direction linear shock forces.

Thus, while the foregoing general advice solutions are at least intended to provide better stability by changing out parts or tightening components, this comes at the sacrifice of maneuverability, time, and expense and still does not adequately address speed wobble. In addition, while the patented solutions may provide some degree of shock absorption by introducing a cushioning element to oppose compressive forces so as to purportedly improve ride quality, they are not designed to address the speed wobble issue. What is needed, therefore, is an improved skateboard truck assembly for use with skateboards that allows the rider to reduce or prevent speed wobble encountered at higher speeds such as when riding downhill allowing for increased control of the skateboard without sacrificing maneuverability while being compatible with a wide variety of different types of skateboards.

SUMMARY OF THE INVENTION

In accordance with principles of the present invention, a damping system for use with a skateboard deck is provided with a base plate constructed to releasably couple to the skateboard deck and a hanger constructed to couple to the base plate and including an axle for receiving at least one wheel along with a damping element coupling the skateboard deck or the base plate to the hanger and being constructed to introduce restrictive motion stability to the motion of the deck or base plate toward or away from the hanger whenever a deviant alignment is introduced.

In at least one embodiment of the present invention, one or more damping elements may be incorporated per truck assembly.

In at least one exemplary embodiment, the damping element includes a piston with a perforated piston head passing into a chamber filled with a volume of viscous fluid that resists movement of the piston head in opposing directions.

In other exemplary embodiments, the damping element may be attached using a variety of attachment means.

In at least one exemplary embodiment, the damping element may be used to disrupt the growing oscillations between the hanger and the deck when in use to restore the hanger to or retain the hanger in a more normal straight ahead alignment.

In at least one exemplary embodiment, the damping element resists both compression and extension.

Various objects, features, aspects and advantages of the present invention will become more apparent from the following detailed description of preferred embodiments of the invention, along with the accompanying drawings in which like numerals represent like components.

DETAILED DESCRIPTION OF THE PREFERRED EMBODIMENTS

Figure 1:
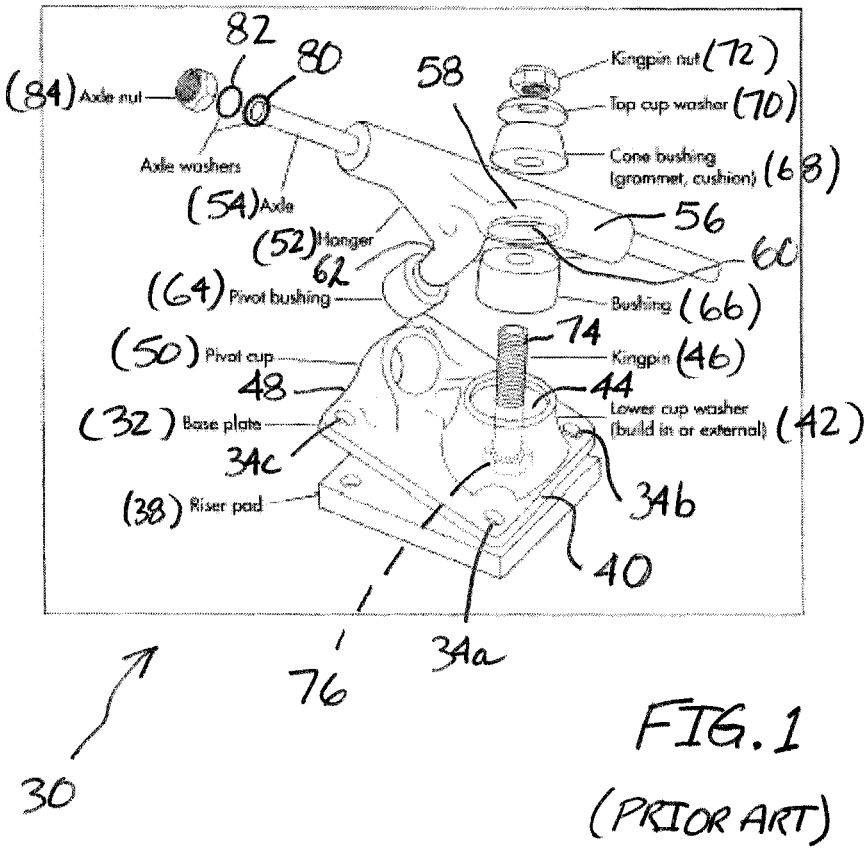
FIG. 1 (PRIOR ART)
FIG. 1 is an exploded view of the components of a conventional truck assembly for attachment to a skateboard deck and a set of wheels.

Referring initially to FIG. 1, an exemplary conventional truck assembly, generally designated 30, is shown in an exploded view to aid this description. The exemplary conventional truck assembly generally includes a base plate 32, roughly a relatively thin rectangular plate in shape, with a set of four apertures 34*a-c* (three are shown with fourth corner aperture hidden) proximate each corner for receiving a set of fasteners such as threaded bolts (not shown) for securing the base plate to a skateboard deck 36, such as that shown in FIG. 2, in a conventional manner. An optional riser pad 38 may be inserted between the base plate and the skateboard deck if desired.

Located proximate the leading edge 40 of the base plate is a lower cup washer 42 that may be integrated into the base plate 32, or otherwise secured to the base plate. As with a conventional truck assembly, the lower cup washer includes a through bore 44 for receipt of a kingpin 46 described below. Proximate the opposing trailing edge 48 of the base plate is a pivot cup 50 in the shape of an angled collar or sleeve.

The truck assembly 30 further includes a hanger 52 or axle housing though which an axle 54 may be inserted or otherwise project laterally outwardly from the ends of the housing. At the leading edge 56, the hanger includes bushing cup 58 or yoke with a through bore 60 while a pivot post 62 projects generally in a perpendicular direction to the transverse axle away from the trailing edge of the hanger and bisects the axle housing. A pivot bushing 64 is disposed on the pivot post.

To secure the hanger 52 to the base plate 32, the kingpin 46, main bushing 66, cone bushing 68, top cup washer 70, and kingpin nut 72 are used as would be understood by one of ordinary skill in the art. For example, the threaded end 74 of the kingpin would be inserted through the lower cup washer 42 with the hexagonal bolt head 76 of the kingpin secured in a complementary hexagonal shaped recess (not shown) in the riser pad 38 or lower deck surface 78. Next, the main bushing would be slipped over the threaded portion of the king pin and fit into the lower cup washer. The pivot post 62 receives the pivot bushing 64 that may be press fit into the pivot cup as the yoke 58 of the hanger is slip fit over the outer end of the main bushing and kingpin. At this point, the threaded end of the kingpin extends through the hanger. The cone bushing is then slipped over the exposed end of the kingpin followed by the top cup washer. Finally, the kingpin nut is screwed onto or otherwise threadably engaged with the kingpin until suitably tightened.

At this point, the hanger 52 is pivotally and rotatably coupled to the base plate 32. Pressing on either outer extreme end of the axle 54 will decrease the distance between the axle and the base plate on the side being pressed toward the base plate and increase the distance between the axle and base plate on the opposite side.

The base plate 32 of the truck assembly 30 (with or without the optional riser pad 38) may be secured the lower surface 78 of the deck 36 using a set of threaded bolts passing through the base plate apertures 34*a-c* and secured with complementary nuts as is well known in the art. Of course, the riser pad (if used), the base plate, and the kingpin 46 may be secured to the deck first and then the hanger 52 coupled thereto. Those skilled in the art are well versed in attaching a conventional truck assembly to a skateboard deck.

Attaching a pair of wheels (not shown) to each axle 54 is generally known in the art. Generally, a first inner axle washer 80 may be slipped over one end of the axle, followed by a wheel with a bearing or race insert, a second outer axle washer 82, and all are secured with an axle nut 84 or locking ring. This is repeated for each axle end so that a pair of wheels is attached to each truck. At this point, the skateboard is essentially in a conventional configuration and provides no additional features for reducing speed wobble other than the usual tightening of the trucks approach by tightening the kingpin nut 72, although this approach reduces the maneuverability of the skateboard as discussed above, and often fails to appreciably reduce the wobble.

Figure 2:
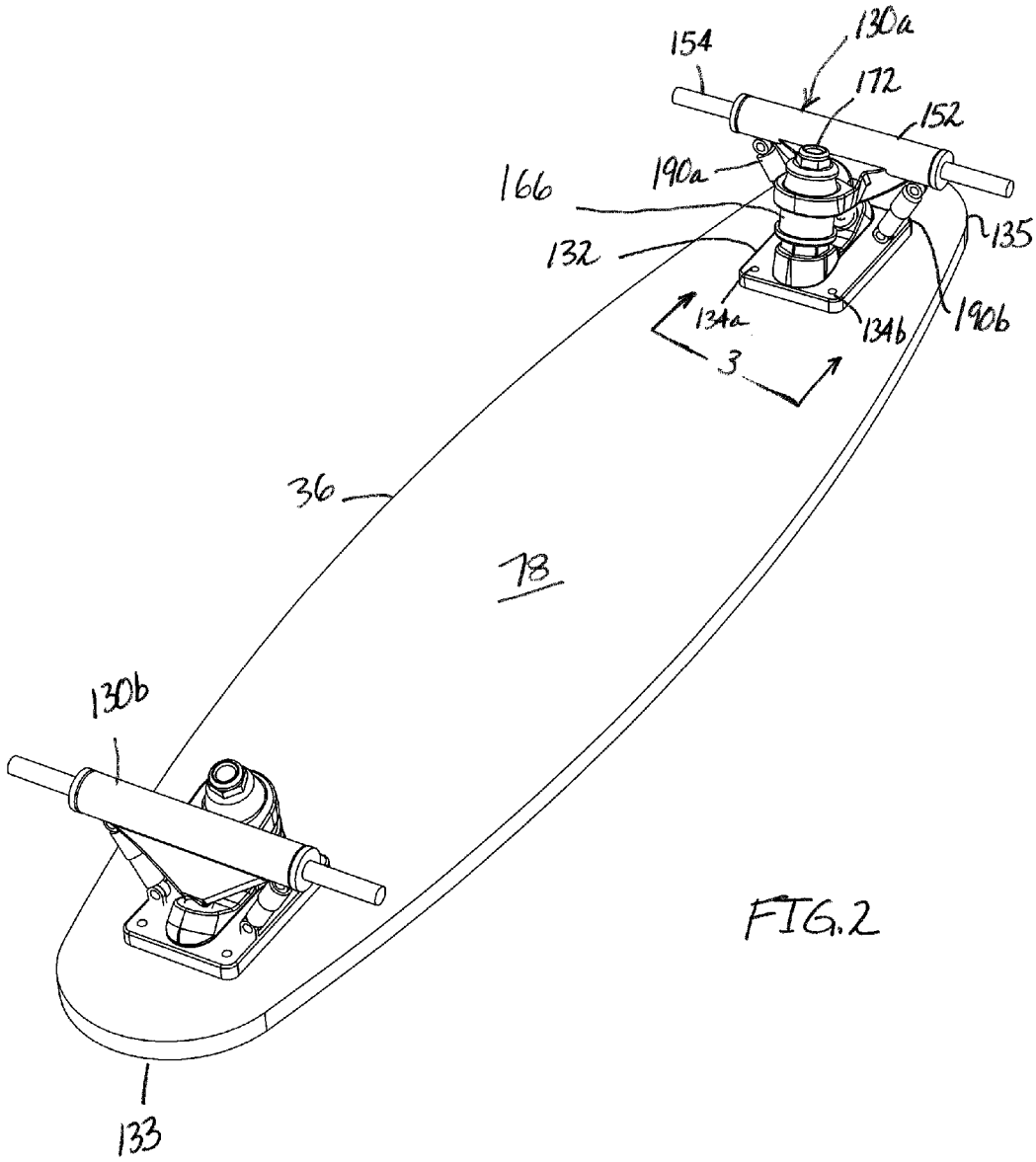
FIG. 2 is a right upper perspective view of an upside down skateboard with the nose facing forward and a damping system installed thereon in accordance with the principles of the present invention.
Figure 4:
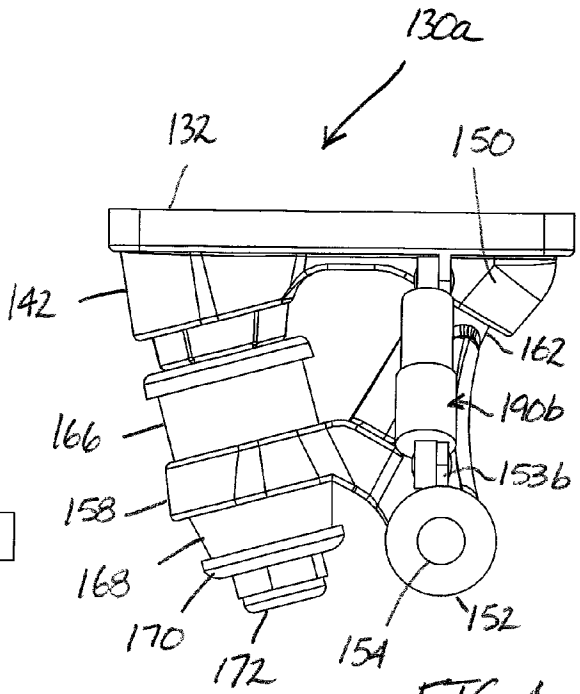
FIG. 4 is a right end view of damping system of FIG. 3.

Referring now to FIG. 2 wherein like elements are like numbered, a first embodiment of a pair of truck assemblies incorporating a damping system, generally designed 130*a-b*, mounted on the lower surface 78 of a conventional skateboard deck 36 and adapted for receiving a conventional set of wheels is illustrated. As shown in FIG. 2, there are two such identical truck assemblies 130*a*, 130*b*, with one mounted near the nose 133 of the deck and the other mounted proximate the tail 135 of the deck. In FIG. 2, the truck assemblies are depicted with their kingpins reversed relative to one another and pointing outwardly from the hex head to the threaded section. These truck mounting positions may be reversed with the kingpins pointing inwardly from the hex to the thread. In addition, the truck assemblies could also be mounted with the parallel kingpins, either both facing forward or both facing rearwards. These alternative kingpin configurations are compatible with each of the embodiments disclosed herein.

With reference now to FIGS. 2-10 and for the ease of this description, an exemplary truck assembly 130*a* will now be described. However, it will be understood that truck assembly 130*b* is identical. As with the conventional truck assembly 30, the exemplary truck assembly 130*a* constructed in accordance with the principles of the present invention includes a base plate 132 that may be pivotally and rotatably secured to a hanger 152 with an axle 154 for receiving a set of conventional wheels. As with the conventional truck assembly, the modified truck assembly 130*a* includes a hanger with a yoke 158 for capturing a kingpin (concealed in these figures) projecting out of a lower cup washer 142 over which a main bushing 166, cone bushing 168, top cup washer 170 are placed and then secured with a kingpin nut 172. The pivot post 162 is also pivotally captured in the pivot cup 150.

As with a conventional truck assembly 30 (FIG. 1), the base plate 132 of the modified truck assembly 130*a* may be secured to the lower surface 78 of the deck 36 (FIG. 2) using a conventional set of fasteners such as bolts and nuts passing through the apertures 134*a-b* for example as would be readily understood by one of ordinary skill in the art.

Where the present invention primarily departs from conventional skateboard truck assembly configurations such as those shown in FIG. 1 is by incorporating a set of two base plate anchor points 137*a-b* and two hanger anchor points 153*a-d* to capture a pair of dual direction (dual action) dampers 190*a-b* or dashpots that couple the hanger to the base plate in this exemplary embodiment as shown in FIGS. 2-8 and cooperate to delay the onset of, reduce, prevent, inhibit, or otherwise dampen building oscillations that give rise to wheel wobble and restore and maintain the hanger in a normal, preferably straight ahead, alignment with the base plate and a steadier, more stable ride while continuing to allow the rider to maneuver by leaning when desired. While the preferred approach when rolling downhill is to maintain or retain the hanger in a normal straight ahead alignment (the preferred alignment) with the deck or base plate (or longitudinal centerline of the deck), it is contemplated that deviations in alignment may occur due to oscillations and thus the dampers may cooperate to restore the alignment to the preferred position.

As shown in FIGS. 2-8, the base plate anchor points 137*a-b* are in the form of a flange, tang, stub, hook, or boss that extends from the base plate body at right angles toward the hanger 152. Each base plate anchor point includes a through-bore 139*a-b* which may be threaded or smooth depending on the fastener used. In a similar manner, the hanger anchor points 153*a-b* are also in the form of a flange, tang, stub, hook, or boss that extends toward the base plate in the same plane as the base plate anchor points 137*a-b* and also include similar through-bores. However, it will be appreciated that the anchor points may project at other angles, be offset from one another, or be recessed into the base plate of hanger. In this exemplary embodiment, the anchor points are integral with their respective base plate or hanger and may be formed during a casting, forging, or stamping process.

Figure 9:
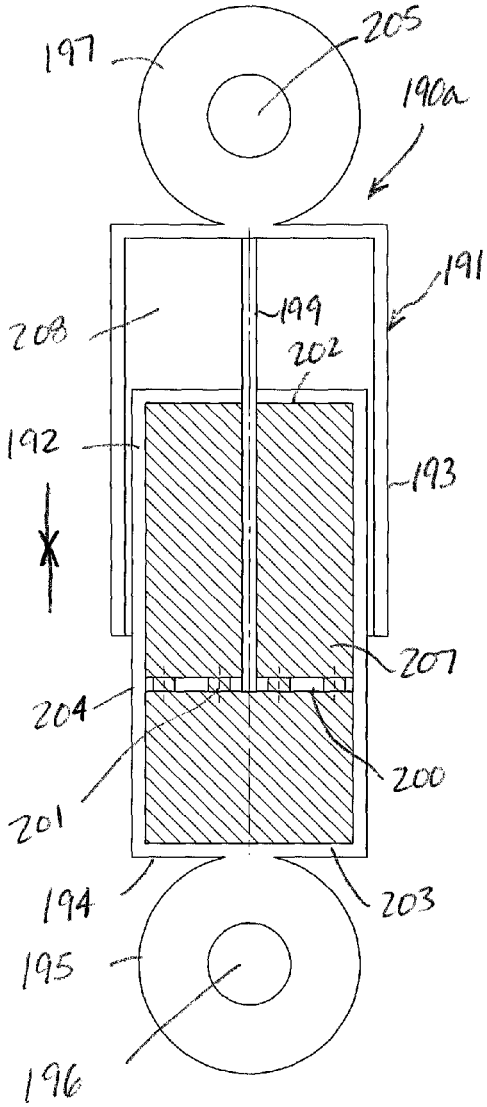
FIG. 9 is a cutaway view of an exemplary damping unit in a compressed state in accordance with principles of the present invention.
Figure 10:
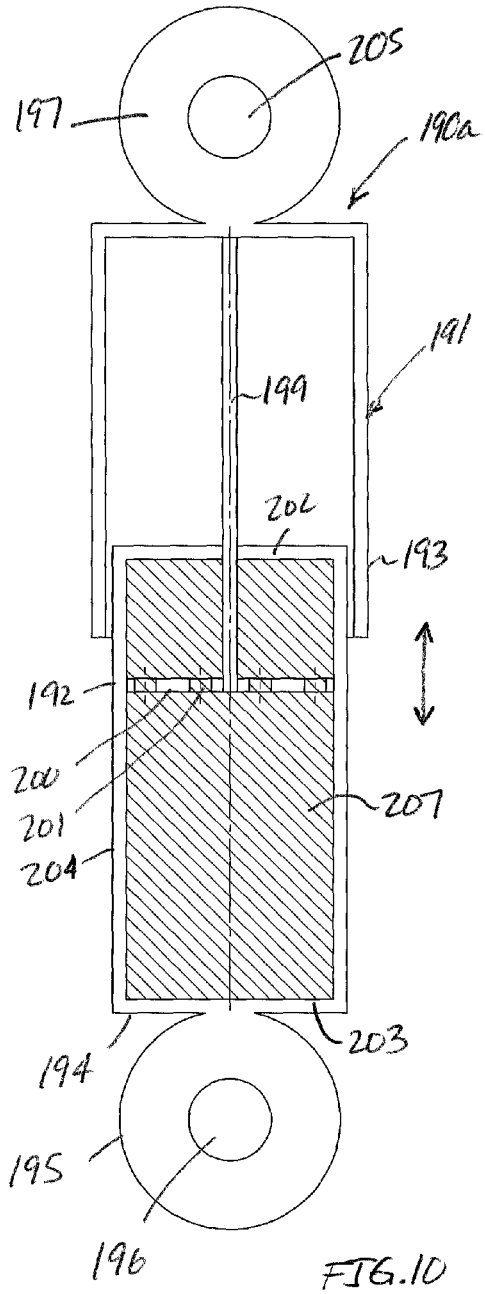
FIG. 10 is a same view as FIG. 9 with the damping unit in an extended state.

Still referring to FIGS. 2-8, spanning each opposing set of anchor points 137*a*, 153*a*, and 137*b*, 153*b* are the dampers 190*a*, 190*b*, respectively, also referred to as oscillation or wobble control devices, wobble reducers, wobble interruption devices, damping units, damping elements, dashpots, and oscillation regulators herein. In this exemplary embodiment, the dampers may be in the form of a hydraulic strut or shock absorber type component. As shown in FIGS. 9-10, each damper (with 190*a* being used as an example) includes a two-piece telescoping housing 191 with a sealed inner primary chamber 192 and an outer shell 193. At the outer end 194 of the primary chamber is a first mount 195 with a through bore 196 while the second mount 197 with a similar through bore 205 is located on the opposing end of the housing on the outer end 198 of the outer shell. An elongated piston shaft 199 projects from the second mount 197 through the outer shell and into inner chamber 192 and terminates in a valve or piston head 200 with a set of perforations 201. Despite the introduction of the piston into the inner chamber, the inner chamber remains sealed. Within the inner chamber is a volume of viscous fluid 206 that may flow through the apertures of the piston head as the piston head is pulled or pushed through the inner chamber. The viscosity of the fluid and the force imparted upon the piston determines the speed at which the piston head travels between opposing end walls 202 and 203 of the inner chamber. The outer shell may be filled with volume of gas 207 but merely rides along the outer surface 204 of the inner chamber 192 and is fixed to the piston shaft and top mount 197.

As shown in FIG. 9, the damper 190*a* may be compressed such as during the tilting of the skateboard deck 36 toward the hanger 152 as will be described in more detail below. This compression forces the piston head 200 deeper into the main chamber 192 through the viscous fluid while a volume of viscous fluid passes through the apertures 201 in the opposite direction. This effectively slows the rate of the piston head travel while allowing some travel to occur.

As shown in FIG. 10, the damper may be extended such as during the tilting of the skateboard deck 36 away from the hanger 152 as will be described in more detail below. This compression forces the piston head 200 deeper into the main chamber 192 through the viscous fluid while a volume of viscous fluid passes through the apertures 201 in the opposite direction. This effectively slows the rate of the piston head travel while allowing some travel to occur in the other direction.

Figure 8:
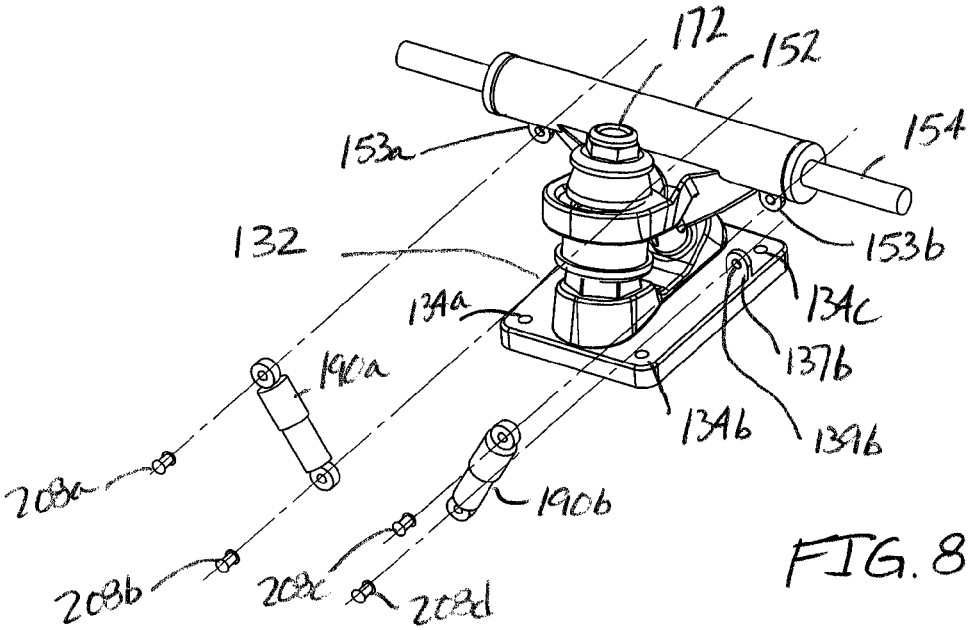
FIG. 8 is an exploded perspective view of the rear truck from FIG. 2, in reduced scale, without the skateboard.

Turning now to FIG. 8, the dampers 190*a*, 190*b* may be secured in place using a set of rivets 208*a-d* or pins that may be used to couple the first mount 195 and second mount 197 respective to the base plate anchors 137*a-b* and the hanger anchor points 153*a-b*. The first or second mount may be secured to the base plate anchor point or the hanger anchor point with the opposing mount secured to the other anchor point using conventional riveting techniques. Other suitable fasteners may also be used. The dampers may either be secured to the anchor points such that their mounts rotate relative thereto or fixed so as to prevent rotation between the respective mount and anchor point. Other suitable fasteners such as a bolt and nut combination, pin and cotter pin combinations, clamps, or brackets may be used. More permanent welds may also be used to couple the damper to the attachment surfaces but this reduces the ease of swapping out dampers with different characteristics or due to wear and tear and thus is not preferred. An exemplary final truck assembly appears in FIG. 3.

With reference to FIGS. 9-12, wherein the truck assemblies 130*a*, 130*b* are assumed to be secured in place to the deck of the skateboard but the deck and wheels have been removed for ease of description, as the rider generates speed, either from traveling downhill or being towed behind a fast moving object, it is not uncommon when using a conventional skateboard assembly for speed wobble to begin at a critical speed. The speed wobble results in the hanger and wheels wobbling and twisting relative to the deck which leads to increased instability and exaggerated deck tilt that progresses until eventually the skateboard is no longer ride-worthy.

Figure 3:
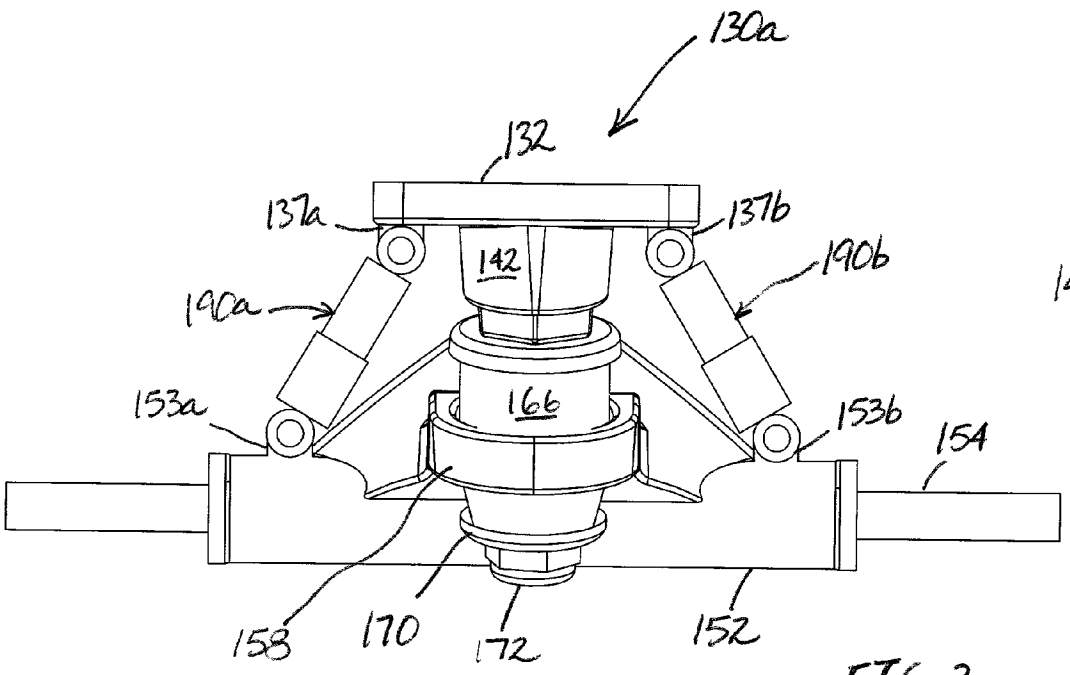
FIG. 3 is a front view of an exemplary damping system taken from FIG. 2, in enlarged scale, without the skateboard and upside down with a hanger on the bottom as it would be in use.
Figure 5:
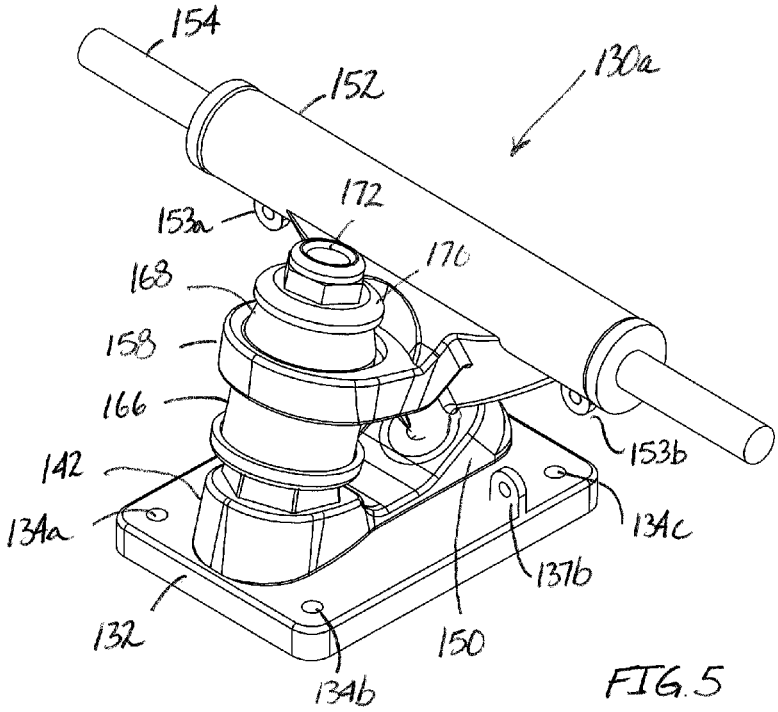
FIG. 5 is the same view of the rear truck of FIG. 2, in enlarged scale, without the damping units and deck.
Figure 6:
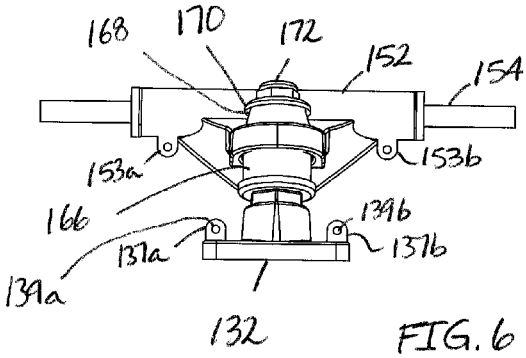
FIG. 6 is a front view of FIG. 5, in reduced scale.
Figure 7:
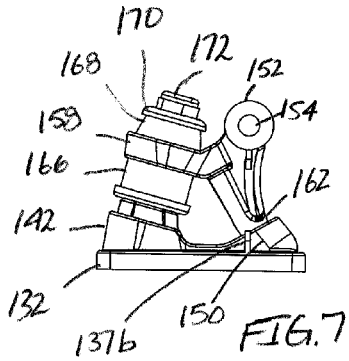
FIG. 7 is a right end view of FIG. 6.
Figure 11:
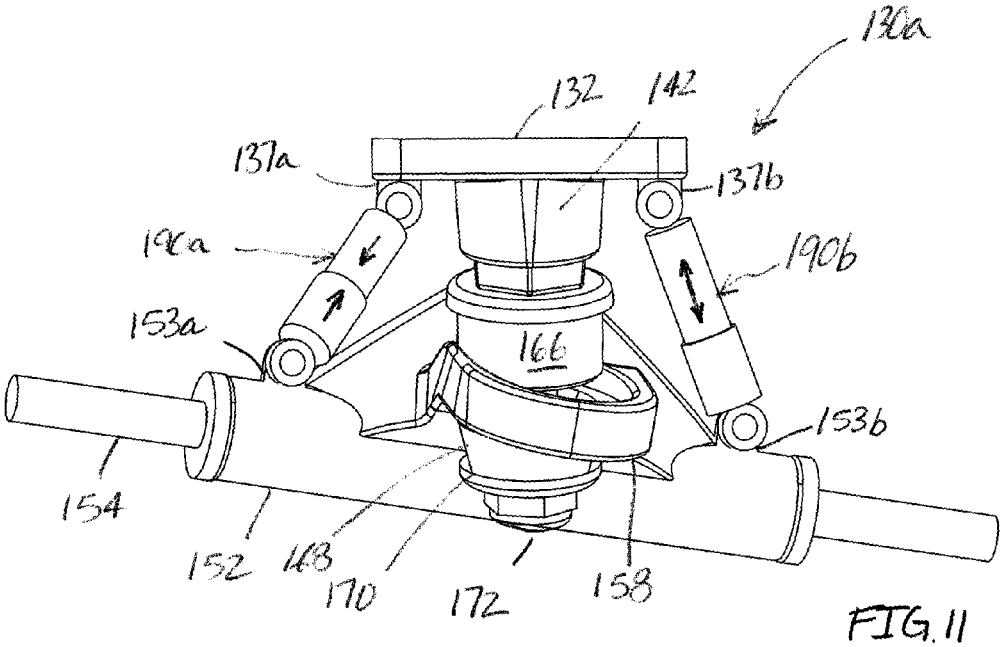
FIG. 11 is a similar view of the damping unit of FIG. 3 with the truck hanger compressing on the left side and extending on the right side and in a partially twisted configuration.

However, in accordance with the present invention, as the deck 36 (FIG. 2) and attached base plate 132 tilts upwardly on the right away from the hanger 152 and downwardly on the left toward the hanger while the hanger starts to rotate out of a centerline as shown in FIG. 11 and relative to the normal forward position as shown in FIG. 3 for example, each of the dampers 190*a*, 190*b* exerts influence on the tilting motion. On the left side, the piston head 200 in the left side damper 190*a* pushes through the viscous fluid 207 as the damper is compressed as shown in FIG. 9. On the right side, the piston head 200 in the right side damper pulls through the viscous fluid 207 as the damper is extended as shown in FIG. 10. The resulting combination of push/pull on opposing sides of the central region of the hanger 152 helps to correct or restore the rotation or twisting of the hanger back to a normal and stable alignment or position as in FIG. 3 thus restricting the travel of the hanger to further extremes relative to the base plate and thus the deck and inhibiting the build-up of speed wobble.

Figure 12:
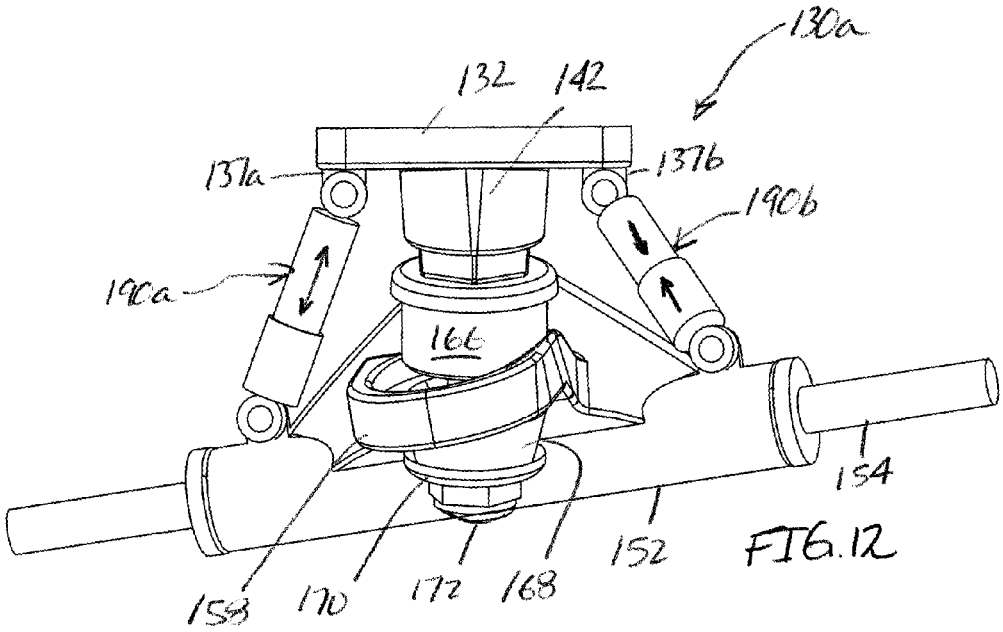
FIG. 12 is a similar view of the damping unit of FIG. 3 with the truck hanger extending on the left side and compressing on the right side and in a partially twisted configuration.

In a similar fashion as shown in FIG. 12, if the hanger 152 strays or deviates from the centerline defined by the normal alignment position in FIG. 3 while the left side damper 190*a* is compressed and the right side damper 190*b* is extended, then the resistance to the pushing action of the piston head 200 within the left side damper and resistance to the pulling action of the piston head 200 within the right side damper will restrict the travel of the hanger relative to the base plate and thus the deck also inhibiting wheel wobble in the other direction by restoring the deviant twisting or rotating motion back to the normative position. While the hanger positions relative to the base plate are shown in exaggerated positions for description purposes, the corrective action imparted by the dampers may occur through very minor changes in rotation or twisting of the hanger 152 relative to the base plate 132. Such corrective action imparted by the dampers primarily depends on a selection of the hydraulic fluid viscosity within the inner chamber of the dampers, the length of the pistons and dampers, the location of the anchor points, the number of dampers used, and the pass through rate of the fluid through the piston head. It will be appreciated that the sensitivity of the corrective action may be altered by varying these variables and that slight deviations may be managed by the dampers while allowed for greater deviations such as those imparted by the rider's lean such as while carving purposefully. One such suitable damper is a DA Series compression and extension speed control damper available from ITT Enidine or a double action hydraulic damper along those lines, preferably adjustable, although it will be appreciated that the size may be varied to accommodate different spacing between the deck or base plate and the hanger and is dependent on the mounting locations. While a hydraulic dual action damper is preferred, it is also contemplated that dampers using gas internals or a gas and hydraulic combination to provide a similar dual action resistance function may be used as well.

By reducing, inhibiting, of delaying the onset of wheel or speed wobble, the rider may more confidently take on steep slopes.

Figure 13:
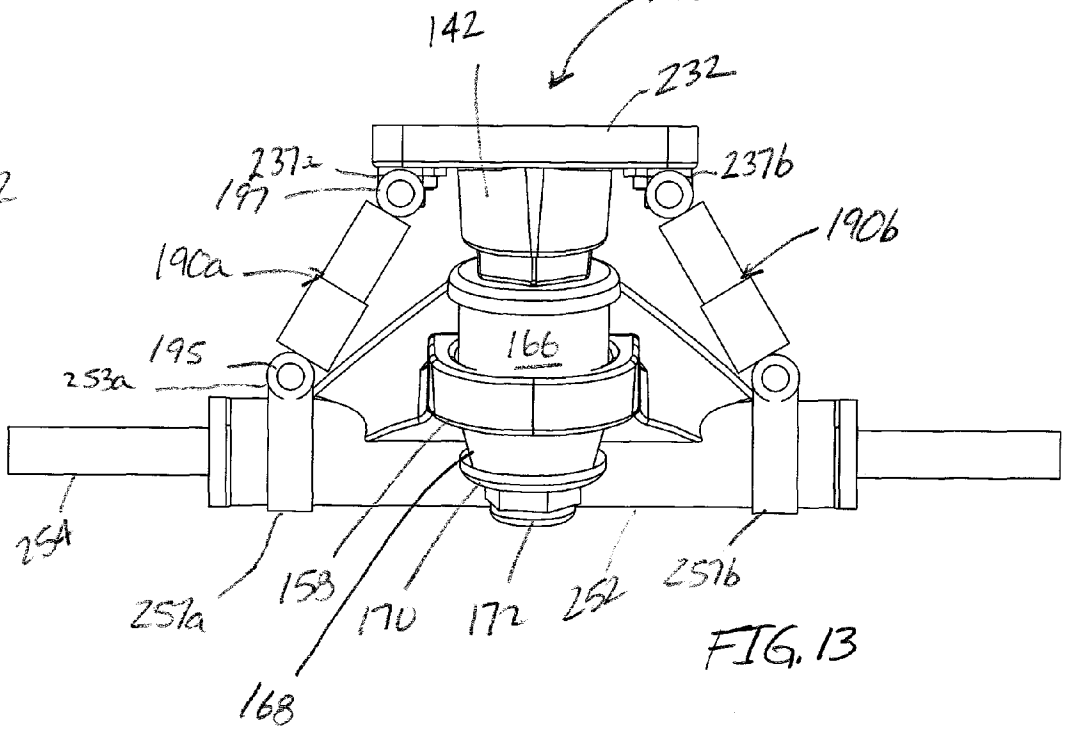
FIG. 13 is a front view of an alternative damping system mount in accordance with the principles of the present invention.
Figure 14:
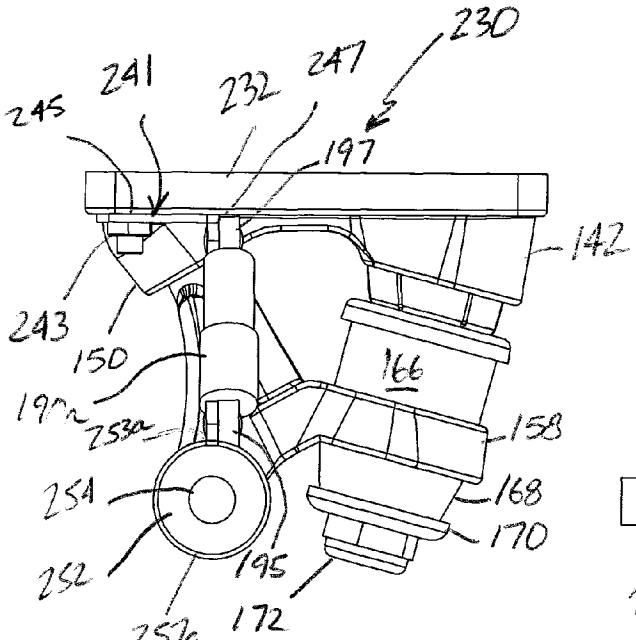
FIG. 14 is a left end view of FIG. 13.

While an exemplary embodiment has been described above, another exemplary embodiment of the truck assembly 230 is shown in FIGS. 13-14 with an alternative base plate anchor points 237*a-b* and alternative hanger anchor points 253*a-b*. In this exemplary embodiment, the base plate 232 has been modified to include another through bore 239 as in FIG. 15 for securing an L-shaped bracket 241 to the base plate using a bolt 243 that may screw into the deck 36 (FIG. 2) or merely into the base plate 232. The bracket includes a first leg 245 that abuts the base plate and a second right angle bent leg 247 that includes a through bore for receiving a rivet as in the earlier embodiment to secure one of the mounts of the damper.

With continued reference to FIGS. 13-14, the hanger anchor points 253*a*, 253*b* may be in the form of a collar 257*a* (using the left side anchor point as an example) that encircles the hanger 252 like a clamp that include an extended tab 259 with a through bore for receiving a rivet or other suitable fastener to secure one of the mounts 195 or 197 of a damper 190*a*, 190*b* to the hanger 252. With this configuration of alternative anchor points, replacement of the dampers is facilitated by a rapid removal from the base plate and hanger of each truck assembly 230.

Figure 15:
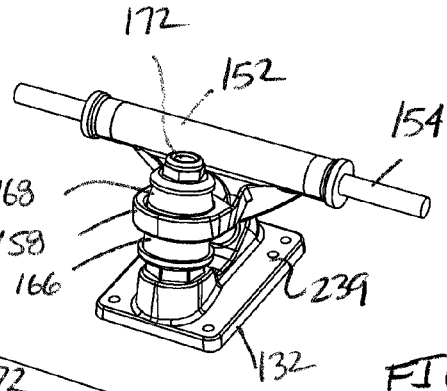
FIG. 15 is a right upper perspective view of a damping system without the alternative mounting bracket or damping unit.
Figure 16:
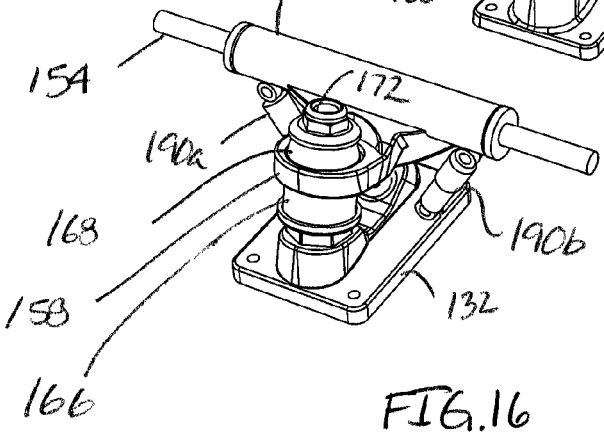
FIG. 16 is the same view as FIG. 15 with the damping unit installed.

Because the base plate and deck behave in a similar manner with respect to the hanger, it is also contemplated to substitute the base plate anchor points with deck anchor points 337*a*, 337*b* as shown in FIGS. 15-16. In this exemplary embodiment, the hanger anchor points 153*a*, 153*b* remain the same as in FIG. 3 but the base plate anchor points have been removed and replaced with anchor points that project from the undersurface 78 of the modified deck 332. These anchor points may be brackets similar to the anchor points 253*a*, 253*b* of FIGS. 13-14 or otherwise secured, recessed, or integrated into the lower surface of the deck 332 to provide an anchor point for one of the mounts of the dampers 190*a*, 190*b*.

Figure 17:
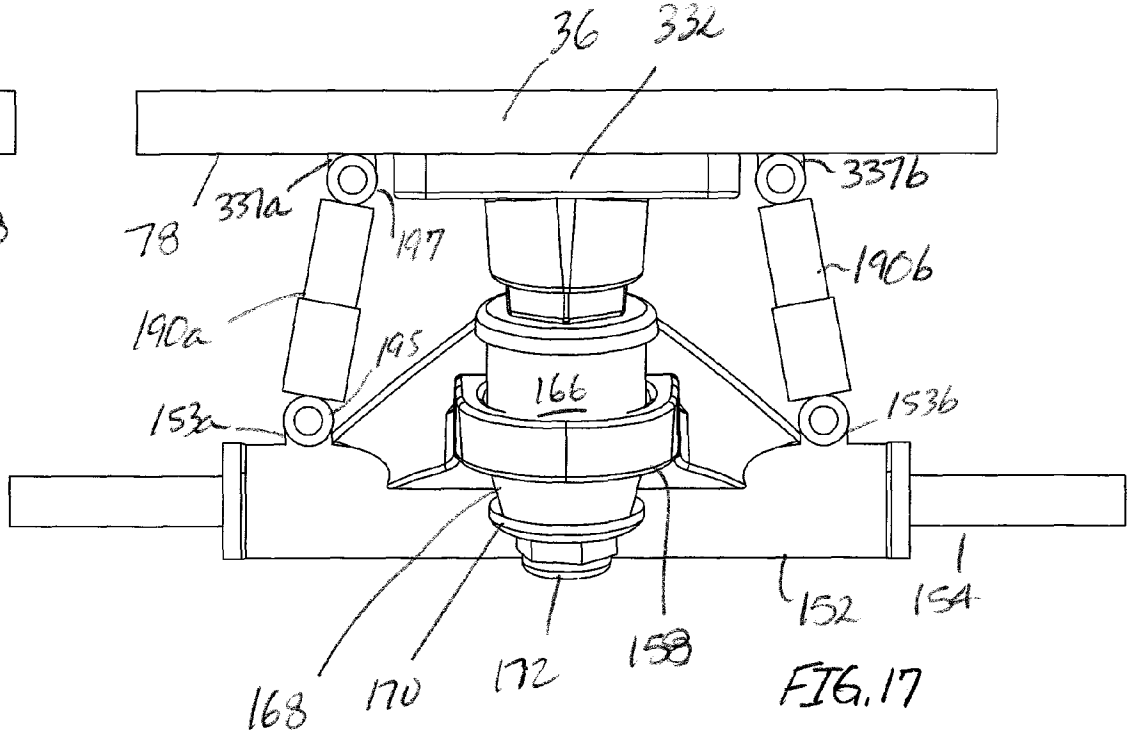
FIG. 17 is a front view of an alternative damping system mounting location with a portion of the skateboard deck shown.
Figure 18:
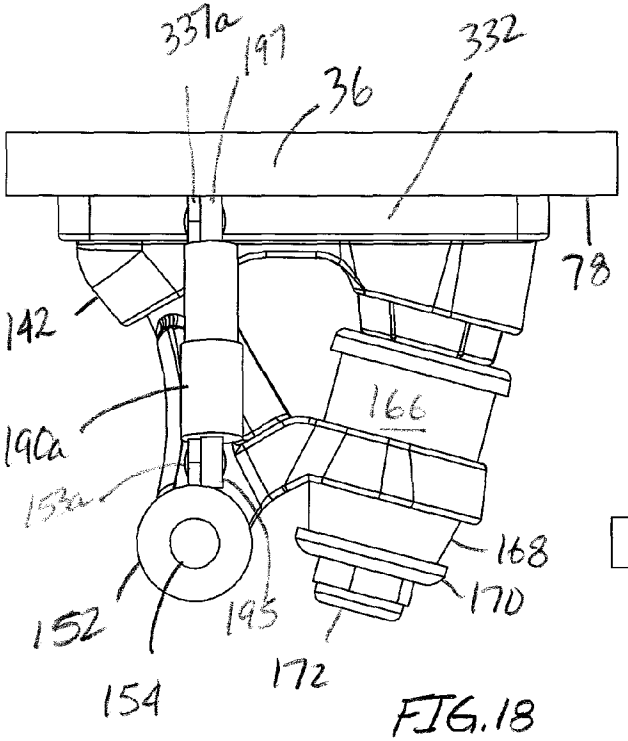
FIG. 18 is a left end view of FIG. 17.
Figure 19:
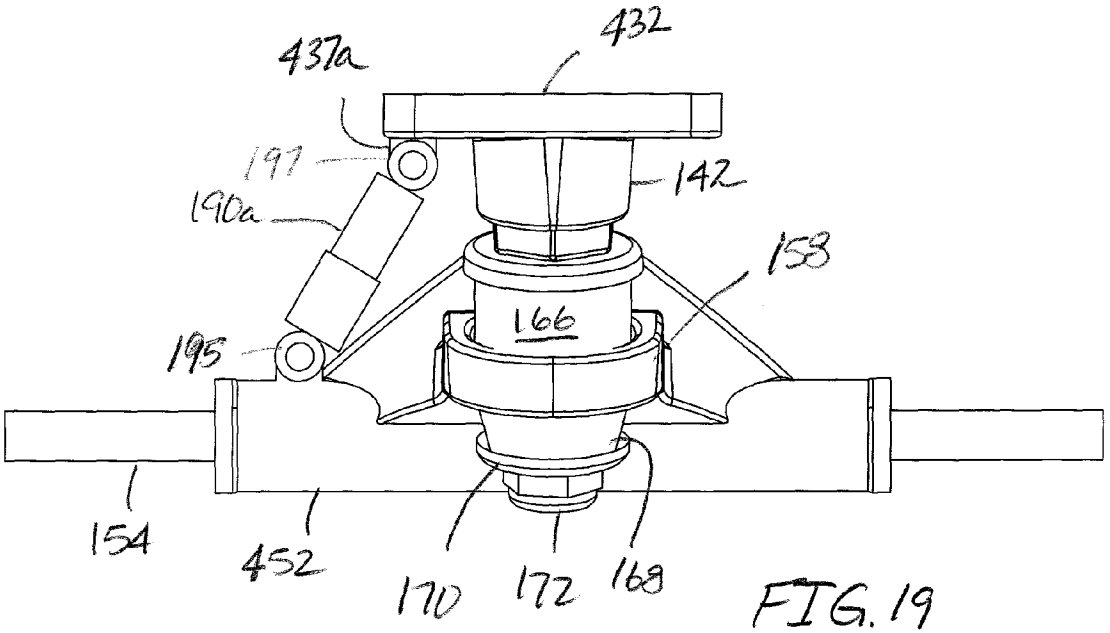
FIG. 19 is a front view of an alternative damping system in accordance with the principles of the present invention.

Moreover, while a dual damper construction is described above, as shown in FIGS. 17-22 a single damper 190*a* may be attached to single tab 437*a* of a modified single tab base plate 432 and the hanger 252 using the integrated anchor points (FIGS. 17-18) or bracket anchor points (FIGS. 19-20) or attach to the deck and hanger (FIGS. 21-22). Alternatively, only a single damper on either side may be added to the truck assembly 130 described above.

Figure 20:
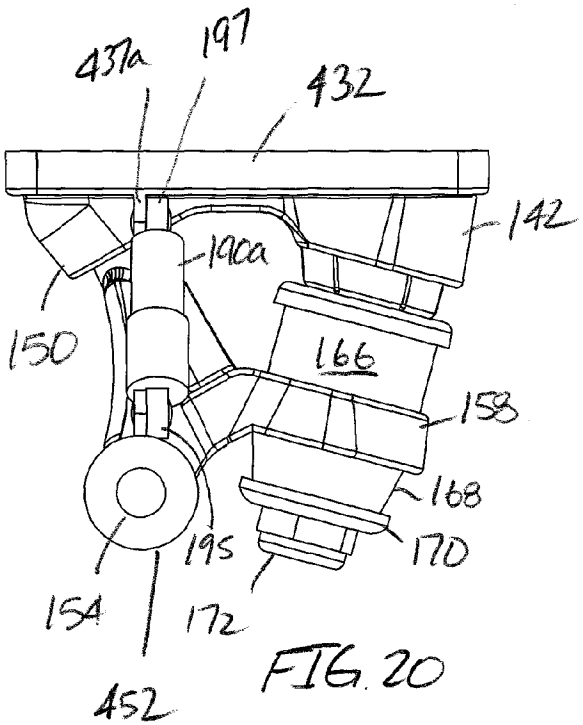
FIG. 20 is a left end view of FIG. 19.
Figure 21:
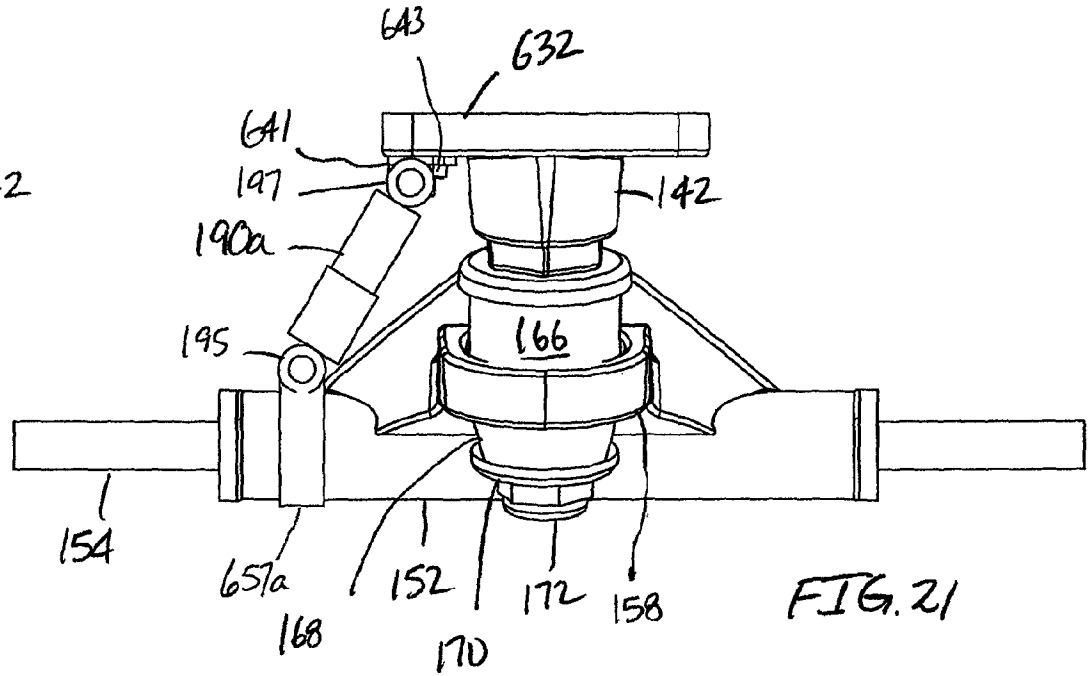
FIG. 21 is a front view of an alternative damping system mount in accordance with the principles of the present invention.
Figure 22:
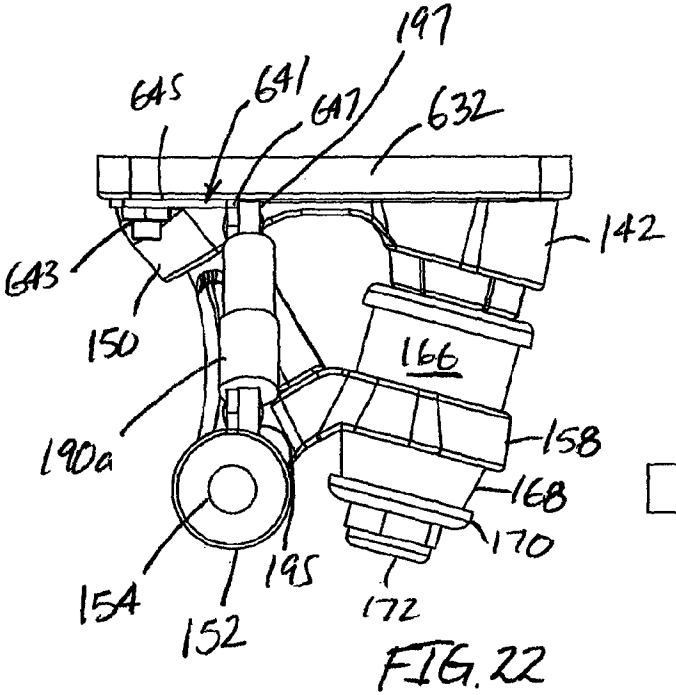
FIG. 22 is a left end view of FIG. 21.

Another alternative of the single damper 190*a* attachment is shown in FIGS. 20-21 that depict a similar bracket system as in FIGS. 13-14 but only on one side with a single bracket 641 having a first leg 645 that may be secured to the deck 632 and a second right angle leg 647 that may be secured to the upper mount 197 of the damper 190*a*.

Figure 23:
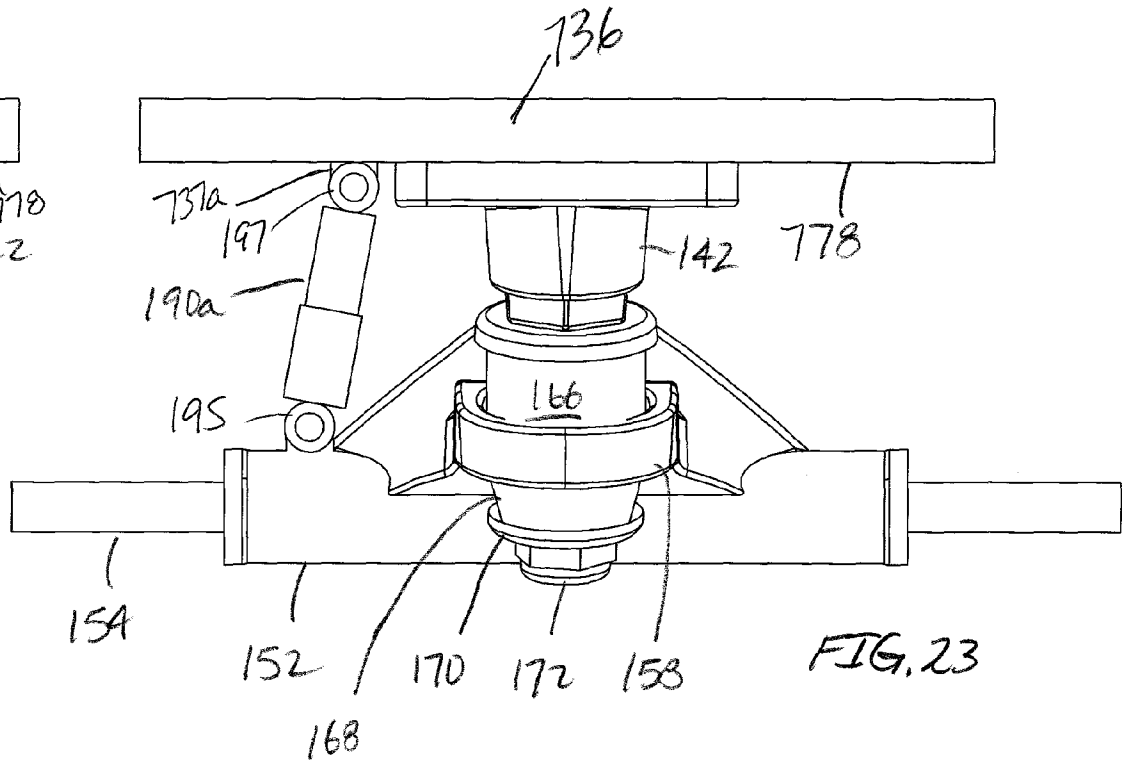
FIG. 23 is a front view of an alternative damping system mounting location with a portion of the skateboard deck shown.
Figure 24:
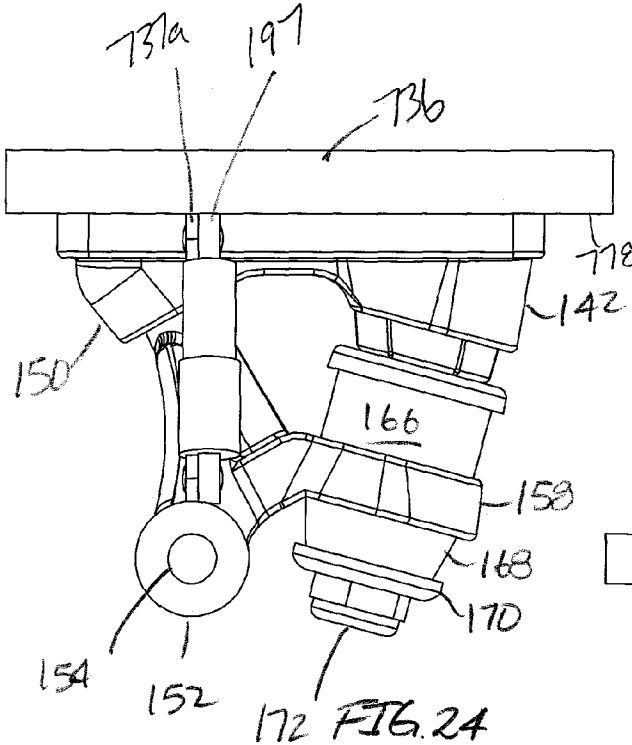
FIG. 24 is a left end view of FIG. 23.

The single damper 190*a* may also be attached to the deck 736 as well. As shown in FIGS. 23-24 the upper mount 197 of the damper may be attached to an anchor point 737*a* projecting from the lower surface 778 of the deck.

In addition to alternatively using dampers 190*a*, 190*b* with varying viscosities, as another feature of the present invention, it will be appreciated that the dampers 190*a*, 190*b* may be adjusted to vary the dual action resistances by rotating the piston shafts to alter the length of the pistons relative to the damper housing.

It will be appreciated that the dampers provides a dual direction damping element in the skateboard assembly, that may either be couple the deck to the hanger or couple the base plate to the hanger since these components will oscillate relative to one another in use as the skateboard rolls along a support surface. The direction of the damping is along the length of the damping unit and multiple damping units cooperate or a single damping unit acts to correct deviations or the twisting motion of the hanger relative to the base plate or deck. Thus, oscillation control, harmonic reduction or inhibition, and the related speed wobble may all be reduced, the onset delayed until greater speeds, or the speed wobble even eliminated by incorporating such dampers thus allowing riders to achieve greater speeds with greater stability. It is anticipated that while one damper may be sufficient, an entire series of dampers may be used for each truck assembly. In addition, if multiple dampers are used, then the corrective and resistance characteristics of each damper may be identical or different to provide different ride stabilities.

It will further be understand that the truck assembly may be integrated into a single unit or that one or more truck assemblies constructed in accordance with the present invention may be incorporated into the final skateboard assembly.

While the above embodiments have been described with respect to dual wheel axles, it is further contemplated that such damping systems may be adapted to single wheel constructions as well.

Specific embodiments and applications of a damping system for skateboards have been described herein. However, it should be apparent, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Any objects cited herein may or may not be applicable to each embodiment and not all objects need be accomplished by any single embodiment.

What is claimed is:

1. A damping system for use with a skateboard deck comprising:

a base plate constructed to releasably couple to the skateboard deck;

a hanger constructed to couple to the base plate and assume a preferred alignment and one or more deviant twisted or tilted alignments relative to the preferred alignment, the hanger including an axle for receiving at least one wheel; and a dual direction, viscous fluid filled damping element coupling the skateboard deck or the base plate to the hanger and being constructed to restore the hanger to the preferred alignment by introducing resistance to the twisting motion of the hanger in either a clockwise or counterclockwise direction relative to the deck or base plate whenever a deviant alignment is introduced.

2. The damping system as set forth in claim 1 further including:

a piston with a piston head projecting into the damping element; and a volume of viscous fluid stored within the damping element and constructed to resist motion of the piston head along at least a portion of the length of the damping element in opposing directions.

3. The damping system of claim 1 wherein:

the damping element couples the base plate to the hanger.

4. The damping system of claim 1 wherein:

the damping element couples the deck to the hanger.

5. The damping system of claim 1 wherein:

the damping element is constructed for telescopic motion and resists compression as the base plate tilts toward the hanger and further resists extension as the base plate tilts away from the hanger.

6. The damping system of claim 1 wherein:

the damping element is constructed to reduce oscillatory motion between the hanger and the base plate.

7. The damping system of claim 1 wherein:

the damping element includes a volume of viscous fluid and a perforated piston head coupled to the hanger body or base plate, the piston head being constructed to allow at least a portion of the volume of viscous fluid to pass therethrough and still decelerate the moving piston head throughout at least a portion of the length of the damping element.

8. The damping system of claim 1 wherein:

the damping element is constructed to inhibit growing oscillations introduced by the twisting of the hanger relative to the deck.

9. The damping system of claim 2 wherein:

the damping element is adjustable with respect to resistance to motion of the piston head through the viscous fluid.

10. The damping system of claim 1 wherein:

the ends of the damping element are coupled directly to the base plate and the hanger.

11. The damping system of claim 1 further including:

a set of two more damping elements for each hanger.

12. The damping system of claim 1 wherein:

a damping element is located to either side of a centerline passing through the base plate.

13. The damping system of claim 1 wherein:

the damping element is secured to the base plate or deck and the hanger at a right angle.

14. The damping system of claim 1 wherein:

the damping element is secured to the base plate or deck and the hanger at an acute angle relative to the undersurface of the deck.

15. The damping system of claim 1 wherein:

the damping element is secured to the base plate or deck and the hanger at an obtuse angle relative to the undersurface of the deck.

16. The damping system of claim 1 wherein:

the damping element includes a set of opposing mounts secured to the base plate or deck and the hanger and offset from one another.

17. The damping system of claim 1 wherein:

the damping element includes a set of opposing mounts secured to the base plate or deck and the hanger and in the same plane to one another.

18. A damping system for use with a skateboard deck comprising:

a base plate constructed to releasably couple the base plate to the deck;

a hanger including a hanger body with a degree of freedom to twist relative to the base and an axle extending outwardly from the opposing ends of the hanger body and being adapted for rotatably securing at least one wheel; and at least one dual direction oscillation control device constructed with a chamber filled with a viscous fluid and a piston projecting therethrough, the oscillation control device coupling the base plate or deck to the hanger body to limit the magnitude of oscillations associated with the twisting motion of the hanger body in clockwise and counterclockwise directions relative to the base plate by resisting such twisting motion in either direction.

19. A skateboard and truck assembly comprising:

a skateboard deck having a truck mounting region;

a base plate constructed to releasably couple the base plate to the underside of a skateboard deck within the truck mounting region;

a hanger including a hanger body with a yoke, an axle extending outwardly from the hanger body and being adapted for rotatably securing at least one wheel;

a kingpin passing through the yoke;

a set of one more bushings encircling the kingpin;

a kingpin nut threadably received on the kingpin for securing the hanger to the base plate in a first alignment; and at least one speed wobble interruption device constructed to couple the base plate or the deck with the hanger, the interruption device including a viscous fluid filled chamber with a piston constructed to resist motion in opposing directions along the length the chamber to retain the first alignment by inhibiting the oscillatory twisting motion between the hanger and the base plate.

20. The skateboard and truck assembly of claim 19 wherein:

the speed wobble interruption device includes a first mount and a second mount constructed to couple the skateboard deck or the base plate to the hanger, the interruption device further being constructed to interrupt building oscillations between the base plate and the hangar when in use.

* * * * *